US007213951B2

(12) United States Patent
Cowan

(10) Patent No.: US 7,213,951 B2
(45) Date of Patent: May 8, 2007

(54) POLE-MOUNTED SHELF

(76) Inventor: Ray Cowan, 2406 Minuteman Way, Costa Mesa, CA (US) 92626

( * ) Notice: Subject to any disclaimer, the term of this patent is extended or adjusted under 35 U.S.C. 154(b) by 62 days.

(21) Appl. No.: 11/082,477

(22) Filed: Mar. 16, 2005

(65) Prior Publication Data

US 2006/0209548 A1 Sep. 21, 2006

(51) Int. Cl.
*F21S 8/00* (2006.01)

(52) U.S. Cl. ..... 362/431; 362/395; 362/406; 362/407; 362/430; 362/414; 211/153

(58) Field of Classification Search ..... 362/431, 362/395, 406, 407, 430, 414, 132; 211/153
See application file for complete search history.

(56) References Cited

U.S. PATENT DOCUMENTS

| | | | | |
|---|---|---|---|---|
| 475,149 | A | 5/1892 | Pearson | |
| 535,767 | A | 3/1895 | Murdock et al. | |
| 1,919,838 | A * | 7/1933 | Hadly | 248/158 |
| 3,414,199 | A | 12/1968 | Guerri et al. | 311/133 |
| 4,225,909 | A * | 9/1980 | Scholz et al. | 362/367 |
| 5,522,514 | A | 6/1996 | Robinson | 211/188 |
| 5,931,315 | A | 8/1999 | Lorentz et al. | 211/40 |
| 6,123,206 | A | 9/2000 | Zaremba | 211/107 |
| 6,477,966 | B1 | 11/2002 | Petryna | 108/11 |
| 6,837,386 | B1 | 1/2005 | Kent et al. | 211/153 |

* cited by examiner

*Primary Examiner*—Renee Luebke
*Assistant Examiner*—Jessica L. McMillan
(74) *Attorney, Agent, or Firm*—Rutan & Tucker, LLP

(57) ABSTRACT

A functional element is coupled to a retaining element such that the functional element can be releasably coupled to a pole, and more preferably a pole of a furniture item. Even more preferably, the functional element is a shelf, an audio, and/or a display device, and the retaining element comprises a pair of brackets to which the functional element is coupled. Most preferably, the furniture item is a floor lamp having a tubular lamp stand to which the retaining element is coupled.

20 Claims, 2 Drawing Sheets

POLE-MOUNTED SHELF

FIELD OF THE INVENTION

The field of the invention is functionalized furniture, and especially furniture comprising a pole to which a functional element is coupled.

BACKGROUND OF THE INVENTION

Various pole-mounted devices are known in the art, and depending on the particular intended purpose, various configurations have been realized. However, all or almost all of the presently known pole-mounted devices require a support structure that interferes with either function and/or esthetics of the mounted device. Still further, depending on the particular configuration, some of the known pole-mounted devices need to be threaded onto the pole, which is at least inconvenient, if not even impossible in some cases.

For example, as described in U.S. Pat. No. 5,522,514, relatively thick support sleeves retain a shelf above a table in a predetermined position. While such support is relatively simple and can typically implemented without tools, the distance between the shelf and the table is generally predetermined by the size of the support sleeve. Similar configurations are disclosed in U.S. Pat. Nos. 3,414,133 and 5,931,315. To overcome at least some of the problems associated with fixed height, a securing wedge can be slid onto a pole at any desirable position, and a corresponding compression fit element supports a shelf on the securing wedge as taught in U.S. Pat. No. 6,123,206. However, in such configurations, the wedge has to be installed from the top or bottom portion of the pole. Similar difficulties are encountered with the tray system as described in U.S. Pat. No. 6,477,966 in which a first sleeve must be installed from the top or bottom portion of the pole.

Sleeveless storage systems for column-mounting are described in U.S. Pat. No. 6,837,386 where a plurality of pie-shaped segments are affixed to the column by an adhesive strip and/or peripheral strap. Alternatively, adjustable collars have been employed to retain a shelf on a stove pipe as described in U.S. Pat. No. 535,767, and an articulated shelf that is wrap-mounted to a stove pipe was disclosed in U.S. Pat. No. 475,149. While such systems provide at least some advantages, several other disadvantages remain. Among other things, retention of the stove pipe may be less than desirable, and or excessive weight may damage the stove pipe. Also, where adhesive tape is employed, removal of the shelf tends to leave marks or tacky residue.

Therefore, while numerous configurations and methods for pole-mounted devices are known in the art, all or almost all of them suffer from one or more disadvantages. Thus, there is still a need to provide improved configurations and methods for pole-mounted devices.

SUMMARY OF THE INVENTION

The present invention is directed to configurations and methods of pole-mounted devices, and especially relating to those in which the pole is a pole of a furniture item, and in which the device is a shelf, an audio, and/or a display device.

In one preferred aspect of the inventive subject matter, an devices has a pole-engaging element that is configured to releasably retain the element in a predetermined position on a pole (e.g., lamp post of an indoor floor lamp). A shelf is coupled to that pole using the pole-engaging element, wherein the pole-engaging element is at least partially integral with the shelf when the shelf is coupled to the pole. Preferably, an instruction is associated with the pole engaging element and/or the shelf, wherein the instruction provides information to couple the pole-engaging element to the pole.

It is further preferred in such devices that the pole-engaging element is configured to split into a first portion that is separate from a second portion, wherein the first and second portions may have a cutout that form a channel sized and dimensioned to accommodate a lamp post. Similarly, it is preferred the shelf is configured to split into a first portion that is separate from a second portion, and that first and second portions have a cutout that form a channel sized and dimensioned to accommodate the lamp post. Moreover, it is contemplated that the shelf has an upper surface and a lower surface, wherein the lower surface has a recessed area that receives at least part of the pole-engaging element when the shelf is coupled to the lamp post. Alternatively, each of the shelf portions may have an opening between the upper and lower surface that receives at least part of the pole-engaging element when the shelf is coupled to the lamp post.

Suitable pole-engaging element may also have a first element with a threaded portion that is configured to threadably receive at least one of a first and/or a second section of the lamp post, and further include a second element that is configured to couple with the shelf. Where desirable, such pole-engaging elements may have an opening configured to allow passage of an electrical wire from a location outside of the first element to a location inside of the first element.

In another aspect of the inventive subject matter, an apparatus has a shelf having a first and a second portion, wherein each of the first and second portions include a cutout, and wherein the cutouts of the first and second portions form a channel when the first and second portions are proximal to each other. In such devices, it is generally preferred that a pole-engaging element is configured to releasably retain the element in a predetermined position on a pole, and further configured to releasably retain at least one of the first and second portions, wherein the pole-engaging element is at least partially integral with the shelf when the shelf is coupled to the pole (e.g., lamp post of an indoor floor lamp). As above, it is typically preferred that the pole-engaging element is configured to split into a first portion that is separate from a second portion.

In a still further aspect of the inventive subject matter, a lamp comprises a base coupled to one end of a lamp post, and a light source coupled to the other end of the lamp post. A pole-engaging element is configured to retain the element in a predetermined and optionally releasable position on the lamp post between the base and the light source, and a functional device (e.g., shelf, audio device, and/or display device) is coupled to the lamp post using the pole-engaging element. Where the device is a shelf and coupled to the lamp post, it is typically preferred that the pole-engaging element is at least partially integral with the functional device. On the other hand, where the device is an audio or display device, it is preferred that the pole-engaging element movably couples the functional device to the lamp post.

Preferably, the pole-engaging element is a brace that is configured to split into a first portion that is separate from a second portion, and the shelf is configured to split into a first portion that is separate from a second portion, wherein each brace portion is at least partially embedded with in each shelf portion, respectively. Alternatively, the pole-engaging element may comprise a first element with a threaded portion that is configured to threadably receive a first and a second section of the lamp post, and a second element that is configured to couple with at least one of the shelf, the audio device, and the display device.

In still further contemplated aspects, the shelf is configured to split into a first portion that is separate from a second portion, and wherein the pole-engaging element comprises a first and second pin that releasably couples to the first and second portion, respectively. In such devices, it is still further preferred that the first pin of the first portion is positioned such that the first pin is received by an opening in the second portion of the shelf, and that the second pin of the second portion is positioned such that the second pin is received by an opening in the first portion of the shelf.

Various objects, features, aspects and advantages of the present invention will become more apparent from the following detailed description of preferred embodiments of the invention.

DETAILED DESCRIPTION

The inventors have discovered that a pole, and especially a pole of a furniture item can be employed as a supporting structure for a functional device, and most preferably for a shelf, an audio device, and/or a display device.

In one preferred exemplary aspect of the inventive subject matter, an apparatus includes a shelf having a first and a second portion, wherein each of the first and second portions include a cutout, and wherein the cutouts of the first and second portions form a channel when the first and second portions are proximal to each other. A pole-engaging element is preferably configured to releasably retain the element in a predetermined position on a pole and further configured to releasably retain at least one of the first and second portions. It is still further preferred that the pole-engaging element is at least partially integral with the shelf when the shelf is coupled to the pole.

Figure 1:
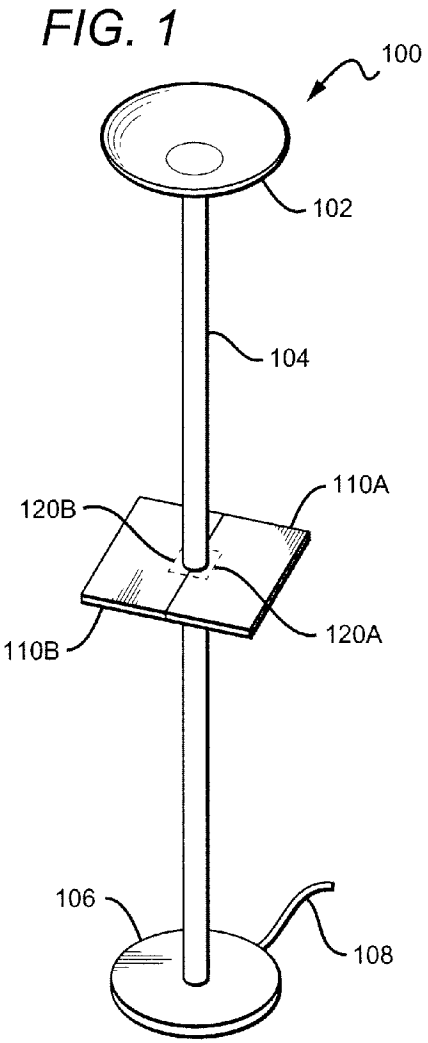
FIG. 1 is an exemplary schematic view of one pole-mounted shelf according to the inventive subject matter.

An exemplary apparatus is depicted in FIG. 1 in which a lamp has an integral shelf that is coupled to the pole of lamp via a pole-engaging element. Here, the floor lamp 100 has a light-emitting portion 102 that is coupled to one end of pole 104, which is coupled on the other end to base 106. Power is supplied to the light-emitting portion via power cord 108 and wiring disposed inside of the lamp. Pole engaging elements 120A and 120B are manufactured as a brace that separates in two portions, wherein each of the braces has a cutout that together form a channel that accommodates and engages with the pole to retain the element on the pole in a desired and/or predetermined position. Most typically, the two portions are coupled to each other via horizontal dowels or screws Coupled to at least one of the pole-engaging elements are shelf portions 110A and 110B that are also separable from each other and also comprise a cutout that accommodates the pole 104.

Figure 2A:
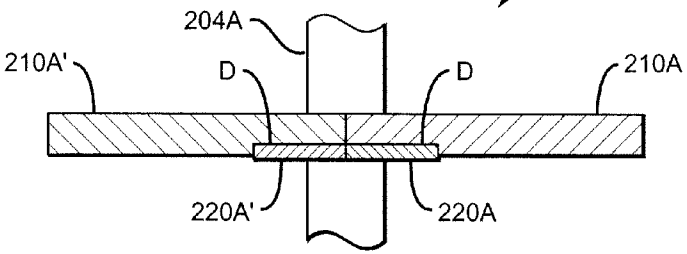
FIG. 2A is a schematic cross-sectional view of an exemplary pole-mounted shelf according to the inventive subject matter.

FIG. 2A provides an exemplary vertical cross-sectional view of one contemplated configuration for retaining the shelf on the pole. Here, the pole-engaging elements 220A and 220A' of assembly 200A arc coupled to each other such that the channel formed by the elements engages with the pole 204A in a retaining manner. Shelf portions 210A and 210A' have corresponding recessed areas D in the bottom surface that are sized such that at least part, and more preferably all of the pole-engaging elements are disposed within the shelf portions. Thus, the term "pole-engaging elements integral with the shelf" as used herein refers to a position of the pole-engaging elements in which at least 10%, more typically at least 30%, and most typically at least 70% of the pole-engaging elements are embedded in the shelf or shelf portion.

Figure 2B:
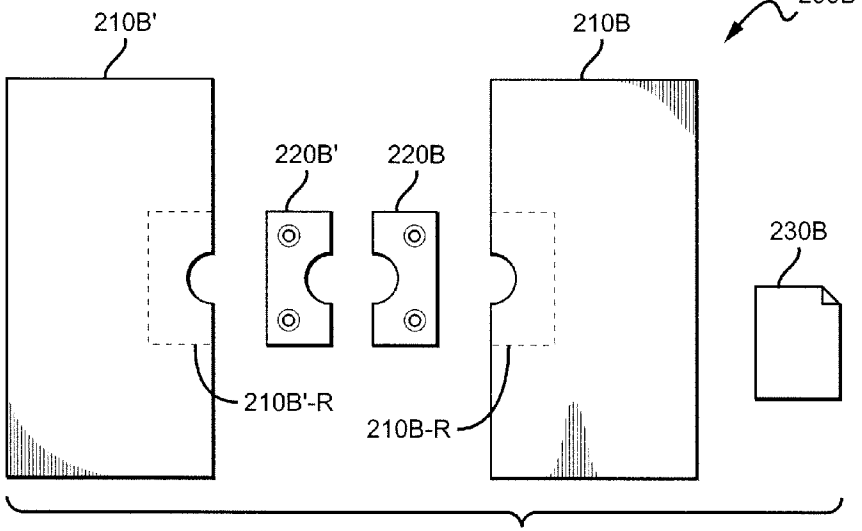
FIG. 2B is a schematic view of the shelf of FIG. 2A in disassembled configuration.

Alternatively, as depicted in FIG. 2B the shelf portions 210B and 210B' of assembly 200B have a cutout 210B-R and 210B'R that is carved into the thickness of the shelf such that a pocket is formed in the shelf between the upper and lower surface of the shelf, wherein the pocket is sized and dimensioned to receive the pole-engaging elements 220B and 220B' (which may be permanently or temporarily coupled to the shelf portions 210B and 210B'. Coupling of the two shelf portions via the pole-engaging elements may be done in numerous manners, including screws, snap-connectors, dowels, etc. Most typically, an instruction 230B is provided to a user for ease of installation.

Figure 3:
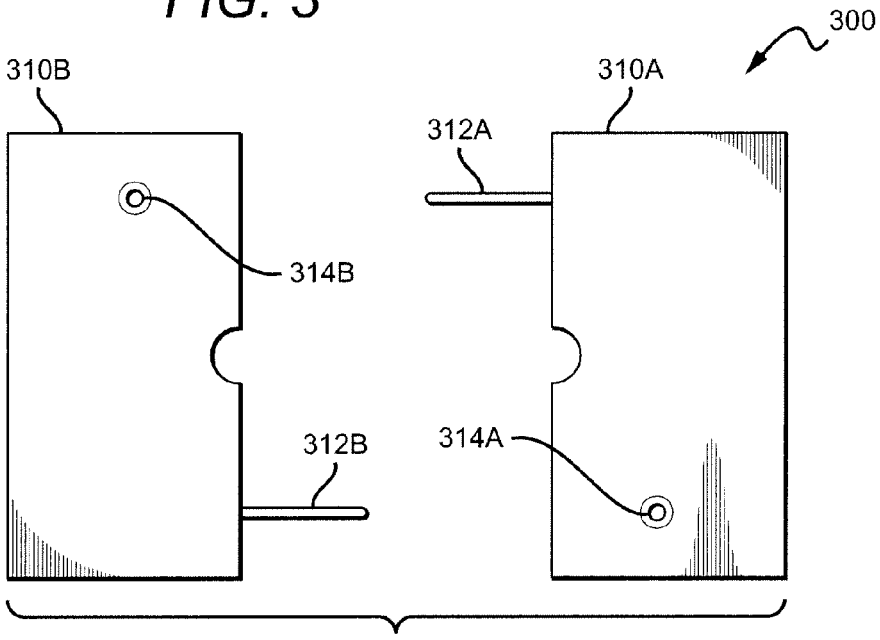
FIG. 3 is a schematic view of another shelf in disassembled configuration according to the inventive subject matter.
Figure 4:
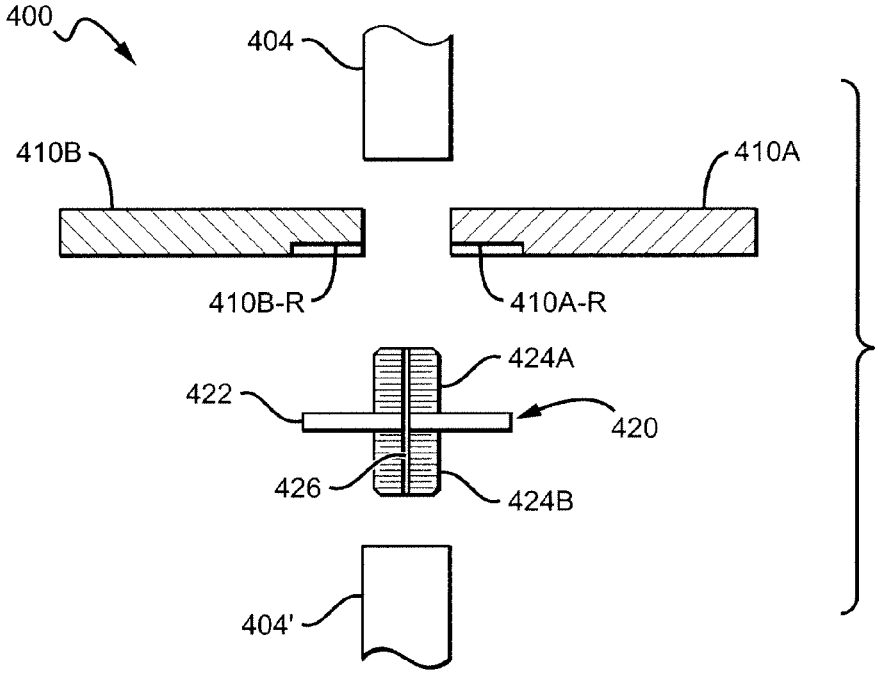
FIG. 4 is a schematic cross-sectional view of a further exemplary pole-mounted shelf according to the inventive subject matter.

In yet further alternative aspects, as shown in FIG. 3, each of the shelf portions 310A and 310B of assembly 300 have a cutout to form a channel for the pole and further have a pair of indirect pole-engaging elements 312A/314B and 312B/314A. Here, the two shelf portions are held together against the pole via pin 312A and 312B that fit into corresponding openings in the opposite plate (most preferably, the openings are drill holes in the face of the plate), wherein the pin engages with a peripheral groove in the nuts 314A and 314B, that can be turned and thereby fastened. Alternatively, kitchen countertop clamps or other integral connectors may also be employed.

Where it is desired that the pole-engaging element is integrally coupled to the pole, it is especially preferred that the pole-engaging element has a first and second threaded portion that is threadably inserted between two threadably connected pole elements as exemplarily depicted in the assembly 400 of FIG. 4. Here, the pole has two sections 404 and 404' that are normally directly connected to each other. For use with the pole-engaging element 420, the two sections 404 and 404' are disconnected and the first and second threaded portions 424A and A424B of the pole-engaging element 420 are connected to the two sections 404 and 404', thereby inserting the pole-engaging element 420 into the pole as an integral part of the pole (Channel 426 may be provided to allow for insertion of one or more electrical wires. The so installed pole-engaging element will then be invisible from the outside of the pole with the exception of the coupling portion 422 that is then inserted into the corresponding recesses 410A-R and 410B-R to couple to the shelf portions 410A and 410B.

With respect to suitable poles, it is contemplated that numerous poles are deemed suitable for use herein. However, it is especially preferred that the pole is a pole or column of a furniture item, and most preferably of a floor lamp. Thus, contemplated poles will have a length between about 12 inches and 4–6 feet (and even taller) and have a diameter of between about ¼ inch to several inches. Furthermore, it is contemplated that the horizontal cross sectional profile of the pole need not be limited to a round or circular profile, but contemplated profiles also include rectangular, square, octahedral, and irregularly shaped profiles.

Consequently, where the shelf portions and/or pole-engaging elements have a cutout to accommodate the shape of the pole, size and configuration of the cutout will vary accordingly. Furthermore, it should be recognized that the shape, size, and material for the shelf may vary considerably. For example, while it is generally preferred that the shelf has a rectangular, and most preferably square shape, alternative shapes, including round (e.g., circular, ovoid, ellipsoid) shapes, irregular shapes, thematic shapes (e.g., cartoon character-shaped, animal shaped, etc.) are also contemplated herein. With respect to the size, it is typically preferred that the shelf has a thickness of at least ⅛ inch, more typically at least ¼ inch, and most typically at least ½ inch, or even thicker. Furthermore, shelves with variable thickness are also deemed suitable for use herein. Depending on the shape, it should be recognized that the overall dimensions will vary, and in most preferred aspects of the inventive subject matter, the smallest dimension (other than thickness—e.g., length or radius) is at least 2 inches, more typically at least 5 inches, and most typically at least 8 inches.

With respect to the number of portions of a shelf it is generally contemplated that the shelf may be composed of a single portion, two portions, three portions (and even more), wherein at least some of the portions assemble in at least partially mating relationship to form the final shelf. Therefore, the position of the cutout in the assembled shelf to accommodate the pole may be peripheral, central, or on any other desired position within the shelf. Similarly, the recessed area(s) in the shelf that receives at least a portion of the pole-engaging element may be positioned at any location that allows coupling of the shelf to the pole via the pole-engaging element. However, pole-engaging elements need not necessarily engage with the shelf in a recess, and all other engaging manners are also contemplated here. For example, the shelf may rest directly on the pole-engaging element, or indirectly (e.g., via a spacer or decorative element between the pole engaging element and the shelf). Furthermore, it is generally preferred that the recessed areas are shaped such as to at least partially, and more preferably entirely receive the pole-engaging elements. Where desired, it should be recognized that the recessed areas may also be in form of a channel that is formed between the upper and lower surface of the shelf to slidingly engage with the pole-receiving element. In such embodiments, the pole-engaging element is typically entirely disposed within the shelf. Of course, it should be recognized that the pole-engaging element may be coupled to the shelf) or shelf portion) in a permanent manner (e.g., by glueing or welding) or temporary manner (e.g., by screwing or use of dowels. Preferably, the shelf is fabricated from wood and finished to a customer's specification (e.g., painted or varnished). However, numerous alternative materials, including natural and synthetic polymers, metals, metal alloys, mineral compositions, and all reasonable combinations thereof are also contemplated. Furthermore, the channel forming portion in the shelf may also include a soft or otherwise deformable material that reduced the likelihood of scratching and/or increase the grip on the pole. For example, the channel forming portion may be lined with a foamed polymer or rubber.

Pole-engaging elements contemplated herein may be classified as either direct engaging elements or as indirect engaging elements. For example, where at least a portion of the pole-engaging element is in contact with the pole or one or more materials surrounding the pole (e.g., rubber spacer), the element is considered a direct pole-engaging element. On the other hand, where no portion of the pole-engaging element contacts the pole or one or more materials surrounding the pole but assists in retaining the shelf on the pole, the element is considered an indirect pole-engaging element.

Direct pole-engaging elements typically comprise at least two separable portions wherein each of the portions will have a cutout that, when the portions are mounted to the pole, form a channel that accommodates the pole. Most typically, such elements will have a configuration as depicted in FIG. 2B, wherein the pole-engaging elements are at least temporarily coupled to each other using manners well known in the art. Alternatively, and especially where the pole engaging element is a single piece, it is preferred that the pole-engaging element has a channel that accommodates the pole.

Depending on the particular configuration of contemplated pole-engaging elements, the manner of retaining the pole-engaging element to the pole may vary. For example, the pole-engaging element may be retained on the pole using compression forces (e.g., between two portions, or using a wedge-shaped channel in one or more portions), direct mechanical devices (e.g., screw, nail, bolt, etc), and/or chemical compositions (e.g., low-tack adhesive). In a further preferred aspect of the inventive subject matter, the pole-engaging element may also be integrated into the pole. For example, the pole-engaging element may be configured as a replacement section of a sectioned pole, wherein the replacement section includes a shelf. In another example, the pole-engaging element may be configured as a spacer element that is placed (e.g., via threaded portions or sliding portions) between two or more pole sections, wherein the spacer element further includes one or more portions to which the shelf or shelf portion can be coupled (see e.g., FIG. 4).

Indirect pole-engaging elements typically comprise at least two portions, wherein one of the portions will be disposed in one shelf portion, and wherein the other portion will be disposed in the corresponding opposite shelf portion. For example, suitable indirect pole-engaging elements include snap-lock fasteners, pin-and-screw nut fasteners (see e.g., FIG. 3), or kitchen counter connectors. Depending on the particular nature of the indirect pole-engaging elements, it should be recognized that these elements may be at least partially embedded into the shelf (typically into the lower surface), or even entire disposed between the upper and lower surface of the shelf portions. Thus, in such indirect pole-engaging elements, it should be recognized that the pole-engaging element may be entirely invisible.

It is further contemplated that the configurations presented herein need not be limited to a shelf, but may indeed include numerous functional elements other than a shelf, including audio devices (e.g., active or passive speaker, radio, baby monitor) and display devices (e.g., TV, LCD monitor for computer, etc.). Most preferably, where such devices are employed, it is generally contemplated that the devices are movably (e.g., rotatably, pivotably, slidingly) coupled to the pole-engaging element. Furthermore, with respect to the coupling of such devices, all manners described for the shelf above are also deemed suitable for use in combination wit alternative devices presented herein.

Most preferably, wiring required for electronic alternative devices is routed through the pole and/or pole-engaging element.

Of course it should be recognized that contemplated shelves/functional elements and pole-engaging elements may be provided as a retrofit to a pole, and especially to a pole of a furniture element, but also as an (optionally) integral part of a lamp, and most typically a floor lamp. In such cases, it is preferred that an instruction is associated with the shelves/functional elements and/or pole-engaging elements, wherein the instructions teach a user to coupled the shelves/functional elements to the pole via one or more pole-engaging elements.

Therefore, in another aspect of the inventive subject matter, the inventor contemplates a device or kit that comprises a pole-engaging element configured to releasably retain the element in a predetermined position on a pole. A shelf may further be included, wherein the shelf is coupled to the pole using the pole-engaging element, and wherein the pole-engaging element is at least partially integral with the shelf when the shelf is coupled to the pole. An instruction may be associated (e.g., a printed instruction on a separate paper, and/or on a packaging of the device or kit) with at least one of the pole engaging element and the shelf, wherein the instruction provides information to couple the pole-engaging element to the pole.

Viewed from another perspective, the inventor contemplates a lamp having a base that is coupled to one end of a lamp post, and a light source that is coupled to another end of the lamp post. A pole-engaging element in the lamp is configured to retain the element in a predetermined and optionally releasable position on the lamp post between the base and the light source, and a functional device (e.g., shelf, audio device, and/or display device), wherein the functional device is coupled to the lamp post using the pole-engaging element. Most preferably, the pole-engaging element is at least partially integral with the functional device when the device is the shelf and coupled to the lamp post, and the pole-engaging element movably couples the functional device to the lamp post when the device is the audio device or the display device.

Thus, specific embodiments and applications of pole-mounted functional elements have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Furthermore, where a definition or use of a term in a reference, which is incorporated by reference herein is inconsistent or contrary to the definition of that term provided herein, the definition of that term provided herein applies and the definition of that term in the reference does not apply.

What is claimed is:

1. An apparatus comprising:

a pole-engaging element configured to releasably retain the element in a predetermined position on a pole of a furniture item or on a pole of a lamp;

a shelf that is configured to be coupled to the pole using the pole-engaging element;

wherein at least 70% of the pole-engaging element is embedded in the shelf when the shelf is coupled to the pole;

an instruction associated with at least one of the pole engaging element and the shelf wherein the instruction provides information to couple the pole-engaging element to the pole to thereby retrofit the furniture item or lamp to include the shelf.

2. The apparatus of claim 1 wherein the pole is a lamp post.

3. The apparatus of claim 2 wherein the pole-engaging element is configured to split into a first portion that is separate from a second portion.

4. The apparatus of claim 3 wherein the first and second portions have a cutout that form a channel sized and dimensioned to accommodate the lamp post.

5. The apparatus of claim 2 wherein the shelf has an upper surface and a lower surface, wherein the lower surface has a recessed area that receives at least part of the pole-engaging element when the shelf is coupled to the lamp post.

6. The apparatus of claim 3 wherein the shelf is configured to split into a first portion that is separate from a second portion, and first and second portions have a cutout that form a channel sized and dimensioned to accommodate the lamp post.

7. The apparatus of claim 6 wherein each of the shelf portions has an upper surface and a lower surface, and wherein each of the lower surfaces has a recessed area that receives at least part of the pole-engaging element when the shelf is coupled to the lamp post.

8. The apparatus of claim 6 wherein each of the shelf portions has an upper surface and a lower surface, and wherein each of the shelf portions has an opening between the upper and lower surface that receives at least part of the pole-engaging element when the shelf is coupled to the lamp post.

9. The apparatus of claim 2 wherein the pole-engaging element has a first element with a threaded portion that is configured to threadably receive a first and a second section of the lamp post, and a second element that is configured to couple with the shelf.

10. The apparatus of claim 9 wherein the pole-engaging element has an opening configured to allow passage of an electrical wire from a location outside of the first element to a location inside of the first element.

11. An apparatus comprising:

a shelf having a first and a second portion, wherein each of the first and second portions include a cutout, and wherein the cutouts of the first and second portions form a channel when the first and second portions are proximal to each other;

a pole-engaging element configured to releasably retain the element in a predetermined position on a pole, and further configured to releasably retain at least one of the first and second portions;

wherein at least 70% of the pole-engaging element is embedded in the shelf when the shelf is coupled to the pole; and an instruction associated with the shelf advising to retrofit a pre-existing structure to thereby include the shelf.

12. The apparatus of claim 11 wherein the pole comprises a lamp post.

13. The apparatus of claim 12 further comprising an instruction to couple the apparatus to the lamp post to thereby retrofit the lamp to include the shelf.

14. The apparatus of claim 11 wherein the pole-engaging element is configured to split into a first portion that is separate from a second portion.

15. A lamp comprising:

a base coupled to one end of a lamp post, and a light source coupled to another end of the lamp post;

a pole-engaging element that is configured to retain the element in a predetermined and optionally releasable position on the lamp post between the base and the light source;

a retrofit functional device selected from the group consisting of a shelf, an audio device, and a display device, wherein the functional device is coupled to the lamp post using the pole-engaging element;

wherein at least 70% of the pole-engaging element is embedded in the functional device when the device is the shelf and coupled to the lamp post; and wherein the pole-engaging element movably couples the functional device to the lamp post when the device is the audio device or the display device.

16. The lamp of claim 15 wherein the pole-engaging element is a brace that is configured to split into a first portion that is separate from a second portion.

17. The lamp of claim 16 wherein the shelf is configured to split into a first portion that is separate from a second portion, and wherein each brace portion is at least 70% embedded with in each shelf portion, respectively.

18. The lamp of claim 15 wherein the pole-engaging element comprises a first element with a threaded portion that is configured to threadably receive a first and a second section of the lamp post, and a second element that is configured to couple with at least one of the shelf, the audio device, and the display device.

19. The lamp of claim 15, wherein the shelf is configured to split into a first portion that is separate from a second portion, and wherein the pole-engaging element comprises a first and second pin that releasably couples to the first and second portion, respectively.

20. The lamp of claim 19 wherein the first pin of the first portion is positioned such that the first pin is received by an opening in the second portion of the shelf, and wherein the second pin of the second portion is positioned such that the second pin is received by an opening in the first portion of the shelf.

* * * * *